US011728589B2

(12) United States Patent
Fukatsu et al.

(10) Patent No.: US 11,728,589 B2
(45) Date of Patent: Aug. 15, 2023

(54) CONNECTOR

(71) Applicant: SUMITOMO WIRING SYSTEMS, LTD., Mie (JP)

(72) Inventors: Yukihiro Fukatsu, Mie (JP); Shinji Iihoshi, Mie (JP); Tomohisa Uchida, Mie (JP); Takeshi Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 24 days.

(21) Appl. No.: 17/408,873

(22) Filed: Aug. 23, 2021

(65) Prior Publication Data

US 2022/0069510 A1 Mar. 3, 2022

(30) Foreign Application Priority Data

Aug. 27, 2020 (JP) ..... 2020-143813

(51) Int. Cl.

| | |
|---|---|
| ***H01R 13/514*** | (2006.01) |
| ***H01R 13/516*** | (2006.01) |
| ***H01R 13/42*** | (2006.01) |
| ***H01R 13/629*** | (2006.01) |

(52) U.S. Cl.

CPC ..... *H01R 13/514* (2013.01); *H01R 13/42* (2013.01); *H01R 13/516* (2013.01); *H01R 13/629* (2013.01)

(58) Field of Classification Search

CPC .... H01R 13/514; H01R 13/42; H01R 13/516; H01R 13/629

USPC ..... 439/701

See application file for complete search history.

(56) References Cited

U.S. PATENT DOCUMENTS

| | | | | |
|---|---|---|---|---|
| 7,354,318 | B2 * | 4/2008 | Murakami | H01R 13/6658 439/701 |
| 9,614,314 | B2 * | 4/2017 | Chikusa | H01R 13/629 |
| 9,673,560 | B2 * | 6/2017 | Iihoshi | H01R 13/4361 |
| 9,722,341 | B2 * | 8/2017 | Chikusa | H01R 13/4223 |
| 9,722,347 | B2 * | 8/2017 | Chikusa | H01R 24/28 |
| 10,498,068 | B2 * | 12/2019 | Takagi | H01R 13/502 |
| 2012/0190229 | A1 * | 7/2012 | Fujii | H01R 13/641 439/345 |

* cited by examiner

*Primary Examiner* — Alexander Gilman
(74) *Attorney, Agent, or Firm* — Venjuris, P.C.

(57) ABSTRACT

A connector 10 includes a first housing 11 and a second housing 12 to be coupled to each other. The first and second housings 11, 12 respectively include a first wall 24 and a second wall 44 partitioning between the first and second housings 11, 12. The first housing 11 includes a first cavity 13, a reference portion 27 constituting a part of the first wall, 24 and a first opening 29 communicating with the first cavity 13. The second housing 12 includes a restricting portion 47 constituting a part of the second wall 44. The restricting portion 47 projects into the first cavity 13 from the first opening 29 beyond the reference portion 27, and a tip thereof in a projecting direction is arranged to face an end part of a wire 30.

6 Claims, 5 Drawing Sheets

CONNECTOR

CROSS-REFERENCE TO RELATED APPLICATIONS

This application is based on and claims priority from Japanese Patent Application No. 2020-143813, filed on Aug. 27, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2019-067562 includes a plurality of housings. The respective housings are stacked in a vertical direction with facing surfaces thereof facing each other. Terminal fittings are accommodated in each housing. The terminal fittings are connected to end parts of wires. Note that a connector configured by stacking a plurality of housings is also disclosed in Japanese Patent Laid-open Publication Nos. 2017-004737, 2004-335305 and 2004-241205.

SUMMARY

In the case of Japanese Patent Laid-open Publication No. 2019-067562, when a worker pinches the wires pulled out from the rear surfaces of the respective housings stacked in the vertical direction, the respective housings may be pushed and deformed by the wires. For example, there is a concern that so-called opening between the mutually facing surfaces of the housings stacked one above the other occurs.

Accordingly, the present disclosure aims to provide a connector capable of suppressing the deformation of housings.

The present disclosure is directed to a connector with a first housing and a second housing to be coupled to each other, and a terminal fitting connected to an end part of a wire, the terminal fitting being accommodated in the first housing, wherein the first and second housings respectively include a first wall and a second wall partitioning between the first and second housings, the first housing includes a first cavity extending in a front-rear direction, a reference portion constituting a part of the first wall and a first opening located behind the reference portion, the first opening communicating with the first cavity, the terminal fitting is arranged inside the first cavity together with the end part of the wire, the second housing includes a restricting portion constituting a part of the second wall, the restricting portion projects into the first cavity from the first opening beyond the reference portion, and a tip of the restricting portion in a projecting direction is arranged to face the end part of the wire.

According to the present disclosure, it is possible to provide a connector capable of suppressing the deformation of housings.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
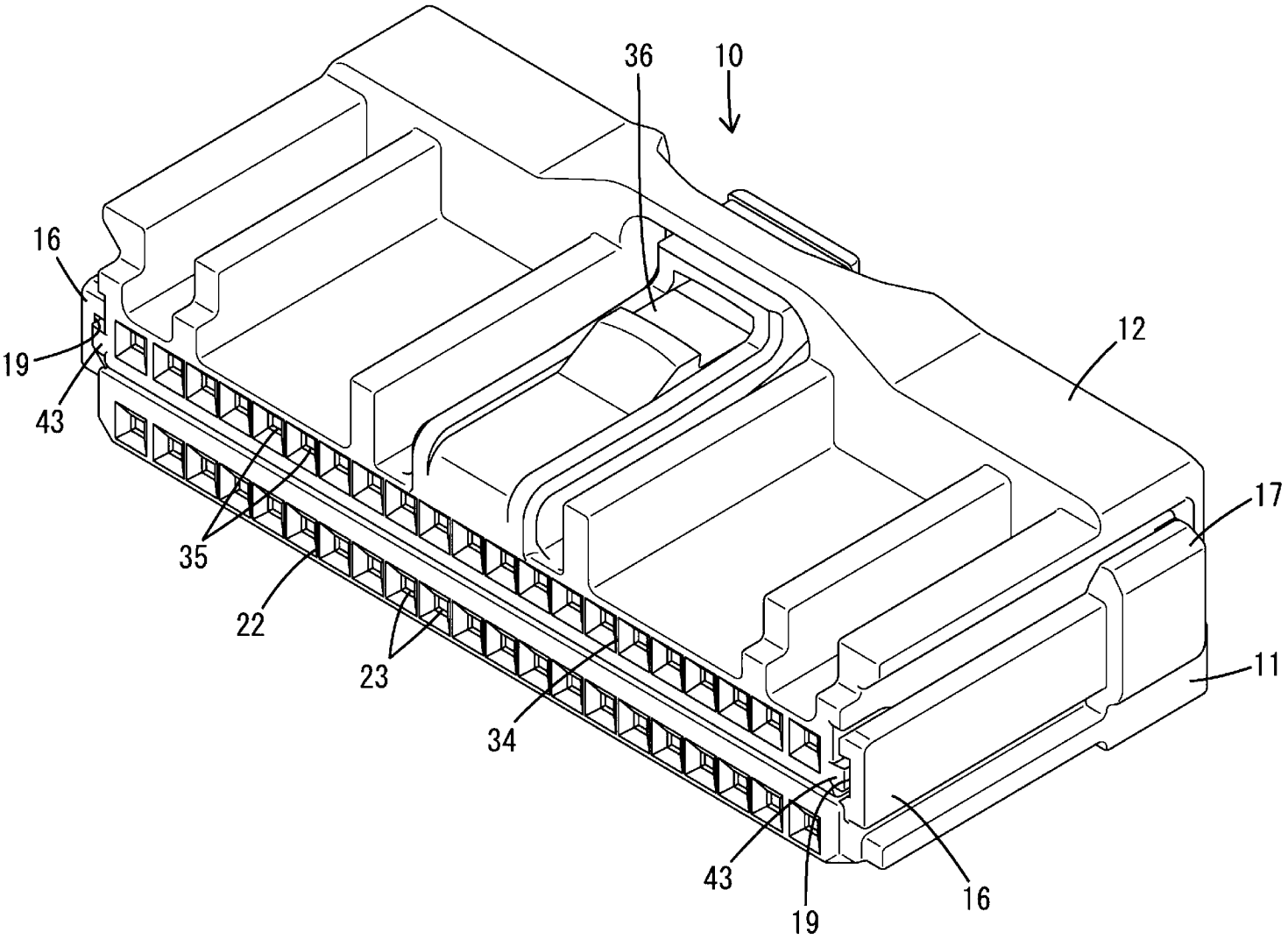
FIG. 1 is a perspective view of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of Present Disclosure]

First, embodiments of the present disclosure are listed and described.

(1) The connector of the present disclosure includes a first housing and a second housing to be coupled to each other, and a terminal fitting connected to an end part of a wire, the terminal fitting being accommodated in the first housing, wherein the first and second housings respectively include a first wall and a second wall partitioning between the first and second housings, the first housing includes a first cavity extending in a front-rear direction, a reference portion constituting a part of the first wall and a first opening located behind the reference portion, the first opening communicating with the first cavity, the terminal fitting is arranged inside the first cavity together with the end part of the wire, the second housing includes a restricting portion constituting a part of the second wall, the restricting portion projects into the first cavity from the first opening beyond the reference portion, and a tip of the restricting portion in a projecting direction is arranged to face the end part of the wire.

If a worker pinches the wires pulled out from the rear surfaces of the respective first and second housings, there is a concern that the wire pulled out from the rear surface of the first housing is displaced toward the second housing and mutually facing surfaces of the first and second housings may be deformed to be open. However, according to the above configuration, a displacement of the wire pulled out from the rear surface of the first housing toward the second housing is suppressed by the contact of the wire with the restricting portion. As a result, the inclination of the end part of the wire and the terminal fitting arranged inside the first housing can be suppressed and, consequently, the deformation of the first and second housings can be suppressed.

Particularly, the restricting portion projects into the first cavity in the above configuration, but the terminal fitting can be inserted into the first cavity from behind in a state before the first and second housings are coupled to each other. Therefore, the presence of the restricting portion does not cause any obstruction in arranging the terminal fitting inside the first cavity.

(2) The first opening may be open rearwardly of the first housing.

According to this configuration, the wire pulled out from the rear surface of the first housing may be largely displaced from the first opening toward the second housing, but a displacement of the wire can be effectively suppressed by arranging the restricting portion in the first opening.

(3) A plurality of the first cavities may be arranged side by side in a width direction in the first housing and the first opening may communicate over and with the plurality of first cavities, and the restricting portion may project over the plurality of first cavities.

According to this configuration, since the first opening and the restricting portion need not be provided for each first cavity, the structure of the connector can be simplified.

(4) The second housing may include a plurality of second cavities extending in the front-rear direction and arranged side by side in the width direction, the second wall may include a second opening located in front of the restricting portion and communicating with the second cavities, the reference portion may be arranged inside the second opening, and the restricting portion may be a rib-like wall extending in the width direction.

According to this configuration, since the restricting portion, which is the rib-like wall extending in the width direction, is provided behind the second opening of the second housing, a reduction in the rigidity of the second housing can be suppressed. Further, since the restricting portion is arranged inside the first opening and the reference portion is arranged inside the second opening, the enlargement of the first and second housings in directions facing each other can be avoided.

[Details of Embodiment of Present Disclosure]

A specific example of the present disclosure is described below with reference to the drawings. Note that the present invention is not limited to these illustrations and is intended to be represented by claims and include all changes in the scope of claims and in the meaning and scope of equivalents.

<Embodiment>

Figure 2:
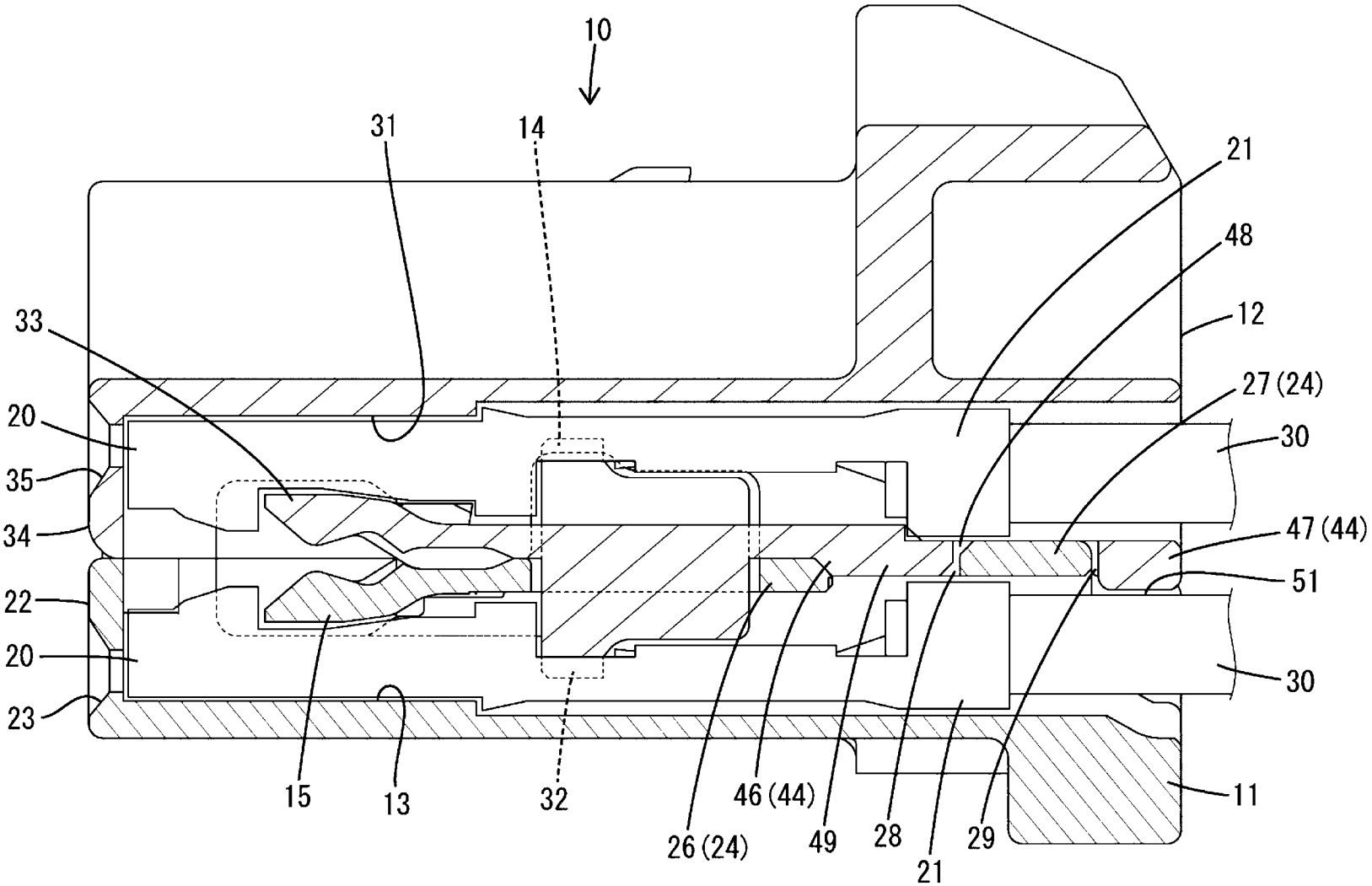
FIG. 2 is a section of the connector.
Figure 4:
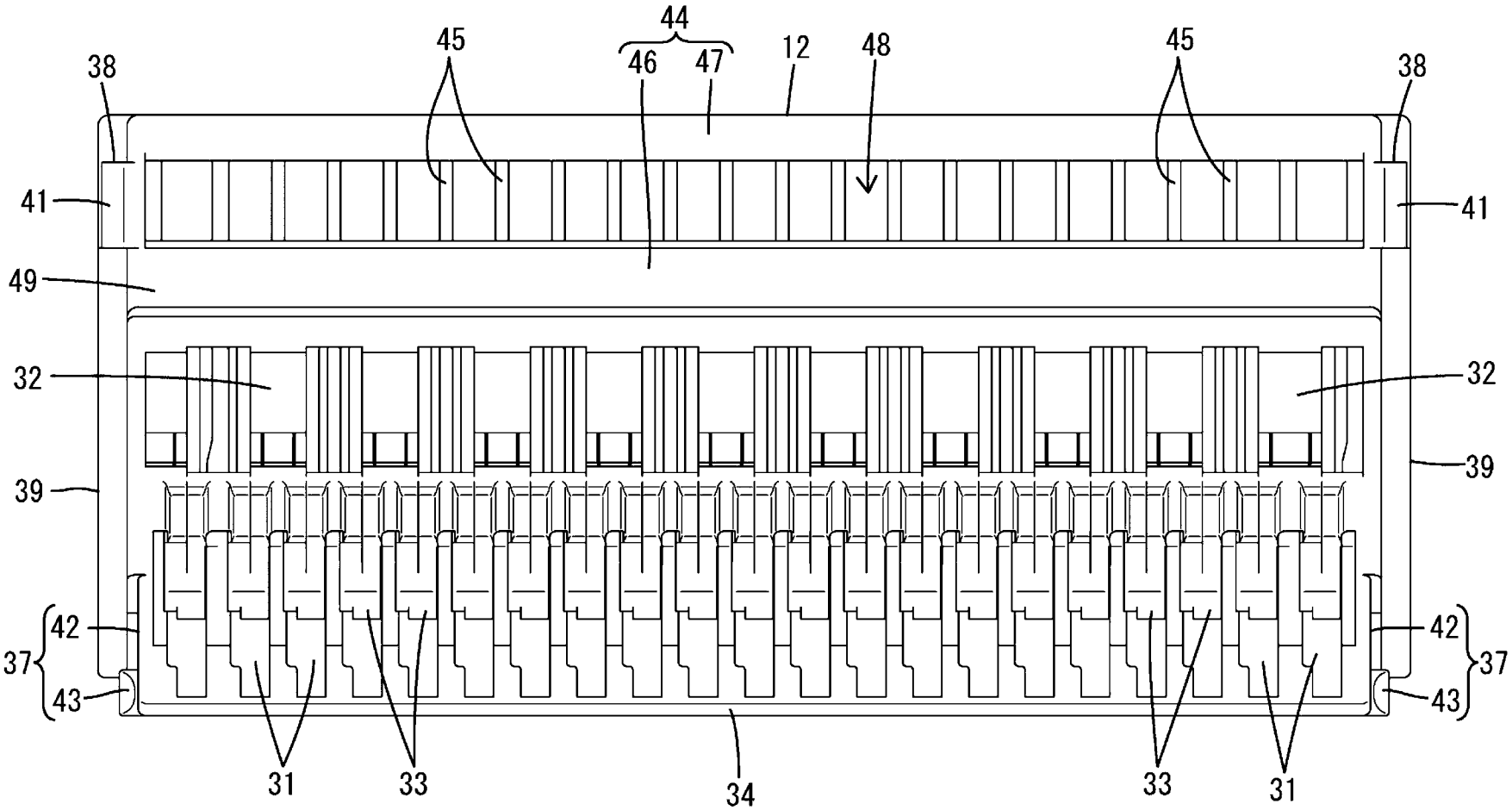
FIG. 4 is a bottom view of a second housing.
Figure 5:
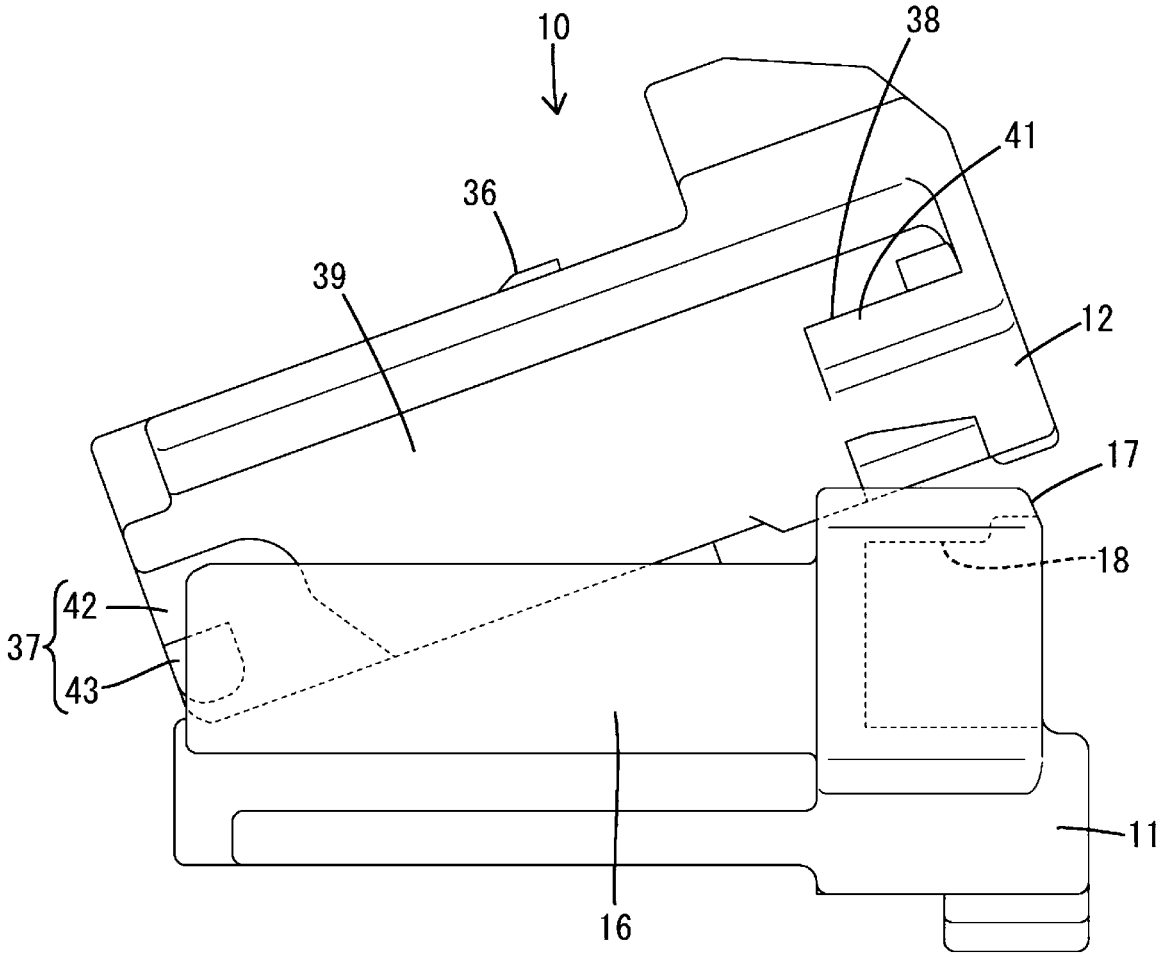
FIG. 5 is a side view showing an intermediate state while the second housing is being rotated toward a coupling position with respect to the first housing.

As shown in FIGS. 1 and 2, a connector 10 of one embodiment includes a first housing 11 and a second housing 12 to be stacked on each other. The first and second housings 11, 12 are connected to an unillustrated mating housing while being coupled to each other. Note that, in the following description, a vertical direction is based on a vertical direction of each of FIGS. 2 and 5. A width direction is based on a lateral direction of each of FIGS. 3 and 4. A left side of each of FIGS. 2 and 5 and 13 is referred to as a front side concerning a front-rear direction. The mating housing is connected to the first and second housings 11, 12 in a coupled state from front.

(First Housing 11)

Figure 3:
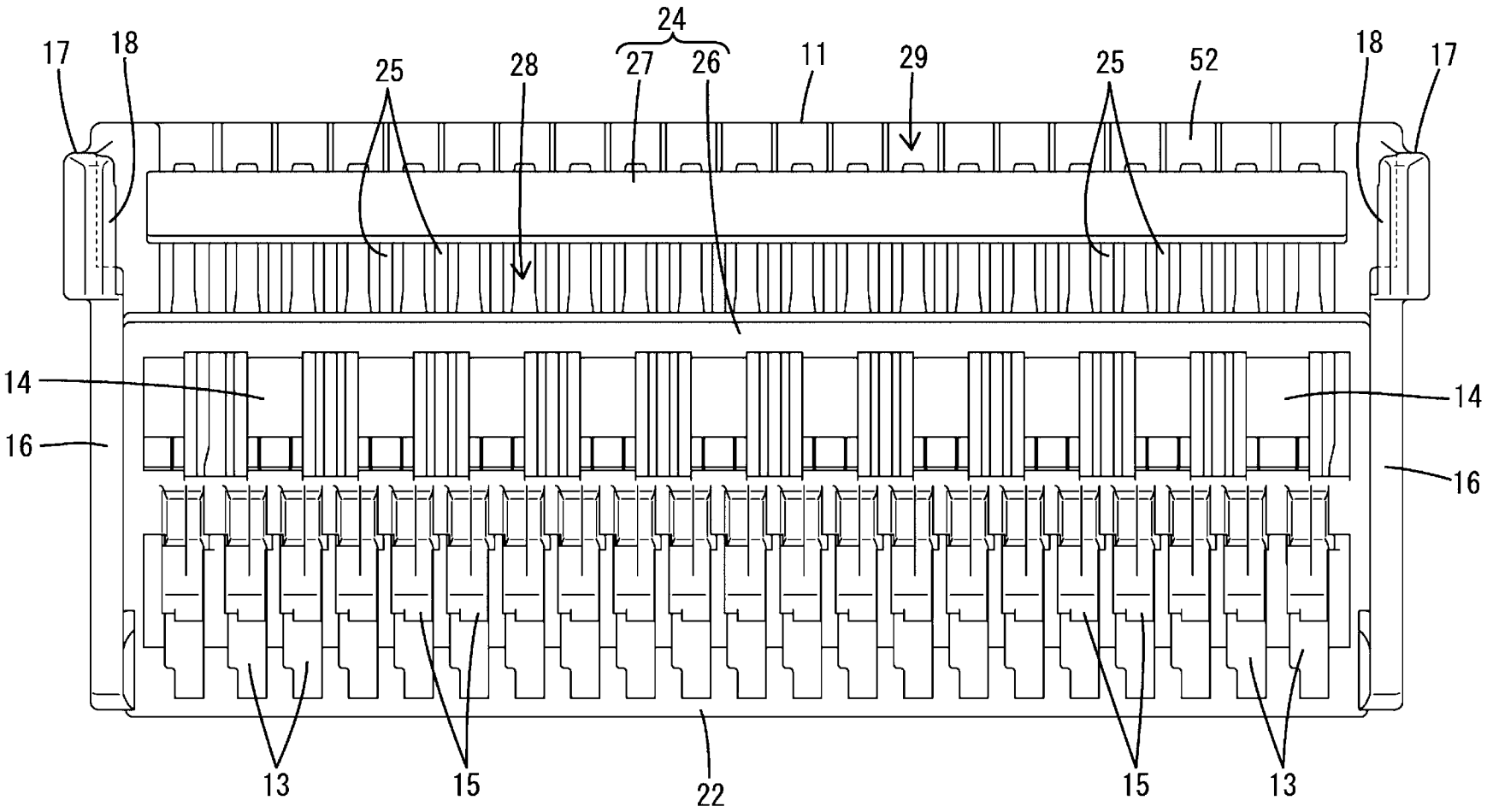
FIG. 3 is a plan view of a first housing.

The first housing 11 is arranged below the second housing 12. As shown in FIG. 3, the first housing 11 has a rectangular shape in a plan view and has a flat shape elongated in the width direction. The first housing 11 includes a plurality of first cavities 13. The respective first cavities 13 are partially open in the upper surface of the first housing 11 and arranged side by side in the width direction.

As shown in FIG. 3, the first housing 11 includes a plurality of first detecting portions 14. The respective detecting portions 14 project from the upper surface of the first housing 11 and are arranged side by side in the width direction. Further, each first detecting portion 14 is arranged to straddle between the adjacent first cavities 13. The first housing 11 includes a plurality of first locking lances 15 in front of the respective first detecting portions 14. The respective first locking lances 15 are exposed on the upper surface of the first housing 11 and arranged at positions corresponding to the first cavities 13.

As shown in FIG. 2, a terminal fitting 20 is inserted into the first cavity 13 from behind. The terminal fitting 20 is locked by the first locking lance 15, whereby escape from the first cavity 13 is primarily restricted. The terminal fitting 20 includes a barrel portion 21 to be connected to an end part of a wire 30. The wire 30 is pulled out rearward from the first housing 11.

As shown in FIGS. 1 and 3, the first housing 11 includes a pair of side walls 16 rising upward on both widthwise end sides. Each side wall 16 has a plate shape extending in the front-rear direction. A first lock portion 17 is provided to project higher on a rear end part of each side wall 16. As shown in FIGS. 3 and 5, a rib-like first lock projection 18 extending in the front-rear direction is provided on the inner surface of each first lock portion 17.

As shown in FIG. 1, a first fulcrum portion 19 is provided on a front end part of each side wall 16. The first fulcrum portion 19 is provided by recessing the inner surface of the side wall 16 and is open forward. The first housing 11 includes a front wall 22 long in the width direction. A plurality of tab insertion openings 23 communicating with the respective first cavities 13 are provided to be open in the front wall 22. A tab of an unillustrated mating terminal fitting is inserted into each tab insertion opening 23 from front. The tab of the mating terminal fitting is electrically connected to the terminal fitting 20 arranged in the first cavity 13.

As shown in FIG. 3, the first housing 11 includes a first wall 24 covering the upper surfaces of the respective first cavities 13. The first wall 24 serves as a part partitioning between the first and second housings 11, 12 when the first and second housings 11, 12 are coupled. The first wall 24 is coupled to first partition walls 25 arranged between the first cavities 13 adjacent in the width direction. Specifically, the first wall 24 includes a first intermediate portion 26 coupled to the respective first detecting portions 14 in the front-rear direction and a reference portion 27 arranged behind the first intermediate portion 26. The front end of the first intermediate portion 26 is coupled to base ends of the respective first locking lances 15.

The reference portion 27 is in the form of a strip (rib) extending in the width direction. As shown in FIG. 2, the lower surface of the reference portion 27 is a flat surface along the front-rear direction and forms the inner surfaces of the first cavities 13. The lower surface of the reference portion 27 is arranged in proximity to the barrel portions 21 of the terminal fittings 20. The upper surface of the reference portion 27 is a flat surface along the front-rear direction and forms the inner surfaces of the second cavities 31 to be described later when the first and second housings 11, 12 are coupled.

As shown in FIG. 3, the first housing 11 includes an intermediate opening 28 between the first intermediate portion 26 and the reference portion 27. The first housing 11 also includes a first opening 29 behind the reference portion 27. A rear part of each first cavity 13 is open upward through the intermediate opening 28 and the first opening 29 except a part covered by the reference portion 27. The first opening 29 is open rearwardly of the first housing 11. The wires 30 pulled out rearward from the first housing 11 are displaceable toward the first opening 29. The first housing 11 includes a plate-like rear bottom wall 52 closing the lower surface of the first opening 29.

(Second Housing 12)

The second housing 12 is arranged above the first housing 11. As shown in FIG. 4, the second housing 12 has a rectangular shape in a bottom view and has a flat shape elongated in the width direction. The second housing 12 includes a plurality of second cavities 31. The respective second cavities 31 are partially open in the lower surface of the second housing 12 and arranged side by side in the width direction.

The second housing 12 includes a plurality of second detecting portions 32. The respective detecting portions 32 project from the lower surface of the second housing 12 and are arranged side by side in the width direction. Further, each second detecting portion 32 is arranged to straddle between the adjacent second cavities 31. The second housing 12 includes a plurality of second locking lances 33 in front of the respective second detecting portions 32. The respective second locking lances 33 are exposed on the lower surface of the second housing 12 and arranged at positions corresponding to the second cavities 31. As shown in FIG. 2, the terminal fitting 20 is inserted into the second cavity 31 from behind. The terminal fitting 20 is structured as described above. Further, the second housing 12 includes a front wall 34 and a plurality of tab insertion openings 35 similar to those of the first housing 11.

As shown in FIG. 1, the second housing 12 includes a lock arm 36 projecting rearward from a front end part on a widthwise central side of an upper surface. The lock arm 36 locks the mating housing and holds the connector 10 and the mating housing in a connected state.

As shown in FIG. 4, the second housing 12 includes second fulcrum portions 37 and second lock portions 38 on side surface portions 39 on both widthwise end sides. A pair of the second lock portions 38 are arranged on rear end sides of the respective side surface portions 39. The second lock portion 38 includes a rib-like second lock projection 41 extending in the front-rear direction on the side surface portion 39. The second lock projection 41 is lockable to the first lock projection 18.

A pair of the second fulcrum portions 37 are arranged on front end sides of the respective side surface portions 39. As shown in FIGS. 4 and 5, the second fulcrum portion 37 includes a recessed groove 42 formed by recessing the side surface portion 39. The recessed groove 42 is open forward and rearward. The second fulcrum portion 37 includes a rotating portion 43 inside the recessed groove 42.

As shown in FIG. 4, the second housing 12 includes a second wall 44 covering the lower surfaces of the respective second cavities 31. The second wall 44 serves as a part partitioning between the first and second housings 11, 12 when the first and second housings 11, 12 are coupled. The second wall 44 is coupled to second partition walls 45 arranged between the second cavities 31 adjacent in the width direction. Specifically, the second wall 44 includes a second intermediate portion 46 coupled to the respective second detecting portions 14 in the front-rear direction and a restricting portion 47 arranged behind the second intermediate portion 46. The front end of the second intermediate portion 46 forms base ends of the respective second locking lances 33. As shown in FIG. 2, the rear end of the second intermediate portion 46 is arranged behind the rear end of the first intermediate portion 26 when the first and second housings 11, 12 are coupled.

As shown in FIG. 4, the restricting portion 47 is in the form of a strip (rib) extending in the width direction and arranged in a rear end part of the second housing 12. As shown in FIG. 2, the rear surface of the restricting portion 47 forms the rear surface of the second housing 12. The upper surface of the restricting portion 47 is a flat surface along the front-rear direction and forms the inner surfaces of the second cavities 31. The upper surface of the restricting portion 47 is arranged in proximity to the barrel portions 21 of the terminal fittings 20. The lower surface of the restricting portion 47 is a flat surface along the front-rear direction and forms the inner surfaces of the second cavities 31 when the second and second housings 11, 12 are coupled. The lower surface of the restricting portion 47 is also a surface capable of restricting movements of the wires 30. The lower surface of the restricting portion 47 is arranged below the other lower surface of the side wall 44. A vertical thickness of the restricting portion 47 is larger than that of the reference portion 27.

As shown in FIG. 4, the second housing 12 includes a second opening 48 between the second intermediate portion 46 and the restricting portion 47. A rear part of each second cavity 31 is open downward through the second opening 48 except a part covered by the restricting portion 47. An opening width in the front-rear direction of the second opening 48 is smaller than a length in the front-rear direction of the reference portion 27.

(Coupling Method and Coupling Structure of First Housing 11 and Second Housing 12)

In coupling the first and second housings 11, 12, the rotating portions 43 of the second fulcrum portions 37 are inserted into the first fulcrum portions 19 from front. In that state, the second housing 12 is rotated from an upright posture to a horizontal posture via an oblique posture (see FIG. 5) with engaged positions of the first and second fulcrum portions 19, 37 as fulcrums.

When the second housing 12 reaches a position to assume the horizontal posture, the first and second housings 11, 12 are stopped at a coupling position by the locking of the first and second lock projections 18, 41.

With the first and second housings 11, 12 coupled, the second detecting portions 32 enter the first cavities 13 from above and the terminal fittings 20 in the first cavities 13 are secondarily retained by the second detecting portions 32 as shown in FIG. 2. Similarly, the first detecting portions 14 enter the second cavities 31 from below and the terminal fittings 20 in the second cavities 31 are secondarily retained by the first detecting portions 14.

With the first and second housings 11, 12 coupled, a thick rear part 49 of the second intermediate portion 46 enters the intermediate opening 28 from above, the reference portion 27 enters the second opening 48 from below and the restricting portion 47 enters the first opening 29 from above as shown in FIG. 2.

The first and second cavities 13, 31 have a large opening diameter in rear regions for accommodating the barrel portions 21 having a large diameter. Thus, a height increase of the connector 10 needs to be suppressed by thinning wall parts partitioning between the first and second cavities 13, 31. In that respect, since the restricting portion 47 constituting a part of the first wall 24 and the reference portion 27 constituting a part of the second wall 44 are arranged side by side in the front-rear direction and do not overlap in the vertical direction according to the above configuration, a height increase of the connector 10 can be suppressed.

Further, with the first and second housings 11, 12 coupled, the lower surface (tip in a projecting direction) of the restricting portion 47 is arranged beyond the reference portion 27 to be below the lower surface of the reference portion 27. That is, the lower surface of the restricting portion 47 is at a position deep in the first cavities 13. Specifically, the lower surface of the restricting portion 47 is arranged below the upper ends of the barrel portions 21 of the terminal fittings 20 arranged in the first cavities 13.

Here, the end part of the wire 30 is accommodated together with the terminal fitting 20 inside the first cavity 13. The end part of the wire 30 includes a contact portion 51 arranged near and forward of the rear surface of the first housing 11. The contact portion 51 is a coating part of the wire 30 and proximately arranged to be able to contact the lower surface of the restricting portion 47. If the wire 30 is arranged along the front-rear direction, a distance between the lower surface of the restricting portion 47 and the contact portion 51 is shorter than a distance between the upper surface of the restricting portion 47 and a corresponding part of the end part of the wire 30 arranged in the second cavity 31.

For example, if a worker pinches each wire 30 pulled out from the respective first and second housings 11, 12, the end part of the wire 30 arranged inside the first cavity 13 is going to be displaced upward. If this upward displacement of the wire 30 cannot be suppressed, there is a concern that the terminal fitting 20 arranged inside the first cavity 13 is inclined downward toward a front side and presses the lower surface of the first cavity 13 and so-called opening between the mutually facing surfaces of the first and second housings 11, 12 occurs.

However, in the case of this embodiment, if the end part of the wire 30 arranged inside the first cavity 13 is going to be displaced upward, the contact portion 51 contacts the lower surface of the restricting portion 47. Thus, an upward displacement of the wire 30 can be suppressed. As a result, the occurrence of the opening between the mutually facing surfaces of the first and second housings 11, 12 can be suppressed.

Particularly, since the terminal fitting 20 is inserted into the first cavity 13 in the absence of the restricting portion 47, an inserting operation of the terminal fitting 20 into the first cavity 13 is not hindered.

Further, in the case of this embodiment, the plurality of first cavities 13 are arranged side by side in the width direction in the first housing 11, one first opening 29 communicates with all of the respective first cavities 13, and one restricting portion 47 projects over the respective first cavities 13. Thus, the structure of the connector 10 can be simplified as compared to the case where the first opening 29 and the restricting portion 47 are provided for each first cavity 13.

Further, since the rib-like restricting portion 47 extending in the width direction is provided behind the second opening 48 of the second housing 12, a reduction in the rigidity of the second housing 12 can be suppressed. Moreover, since the restricting portion 47 is arranged inside the first opening 29 and the reference portion 27 is arranged inside the second opening 48, the enlargement of the first and second housings 11, 12 in the vertical direction can be avoided.

[Other Embodiments of Present Disclosure]

The embodiment disclosed this time should be considered illustrative in all aspects, rather than restrictive.

Although the first housing is arranged below the second housing in the case of the above embodiment, a first housing may be arranged above a second housing as another embodiment. Alternatively, a first housing and a second housing may be arranged side by side in the width direction.

Although the reference portion and the restricting portion are arranged side by side in the front-rear direction in the case of the above embodiment, a reference portion and a restricting portion may be arranged to overlap in the vertical direction as another embodiment.

Although the second housing is rotated and coupled to the first housing in the case of the above embodiment, a first housing and a second housing may be brought closer and coupled from a state where these housings are separated in parallel to each other.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a first housing and a second housing to be coupled to each other; and a terminal fitting connected to an end part of a wire, the terminal fitting being accommodated in the first housing, wherein:

the first and second housings respectively include a first wall and a second wall partitioning between the first and second housings, the first housing includes:

a first cavity extending in a front-rear direction;

a reference portion constituting a part of the first wall; and a first opening located behind the reference portion, the first opening communicating with the first cavity, the terminal fitting is arranged inside the first cavity together with the end part of the wire, the second housing includes a restricting portion constituting a part of the second wall, the restricting portion projects into the first cavity from the first opening beyond the reference portion such that a bottom surface of the restricting portion is lower than that of the reference portion in a state where the first housing and the second housing are coupled to each other, and the bottom surface of the restricting portion in a projecting direction is arranged to face the end part of the wire.

2. The connector of claim 1, wherein the first opening is open rearwardly of the first housing.

3. The connector of claim 1, wherein:

a plurality of the first cavities are arranged side by side in a width direction in the first housing and the first opening communicates over and with the plurality of first cavities, and the restricting portion projects over the plurality of first cavities.

4. The connector of claim 3, wherein:

the second housing includes a plurality of second cavities extending in the front-rear direction and arranged side by side in the width direction, the second wall includes a second opening located in front of the restricting portion and communicating with the second cavities, the reference portion is arranged inside the second opening, and the restricting portion is a rib-like wall extending in the width direction.

5. The connector of claim 1, wherein a vertical thickness of the restricting portion is larger than that of the reference portion.

6. The connector of claim 1, wherein the bottom surface of the restricting portion is arranged below an upper end of a barrel portion of the terminal fitting arranged in the first cavity in the state where the first housing and the second housing are coupled to each other.

* * * * *